US007438252B2

(12) United States Patent
Küsel

(10) Patent No.: US 7,438,252 B2
(45) Date of Patent: Oct. 21, 2008

(54) WINDING DEVICE

(75) Inventor: Bernd Küsel, Hamburg (DE)

(73) Assignee: Phoenix Conveyer Belt Systems GmbH, Bad Blankenburg (DE)

( * ) Notice: Subject to any disclaimer, the term of this patent is extended or adjusted under 35 U.S.C. 154(b) by 382 days.

(21) Appl. No.: 10/560,059

(22) PCT Filed: Apr. 21, 2005

(86) PCT No.: PCT/DE2005/000730

§ 371 (c)(1),
(2), (4) Date: Dec. 8, 2005

(87) PCT Pub. No.: WO2006/012815

PCT Pub. Date: Feb. 9, 2006

(65) Prior Publication Data

US 2007/0095968 A1 May 3, 2007

(30) Foreign Application Priority Data

Jul. 30, 2004 (DE) ..... 10 2004 037 217

(51) Int. Cl.
*B65H 18/14* (2006.01)

(52) U.S. Cl. ..... 242/542.2; 242/542.3

(58) Field of Classification Search ..... 242/541, 242/541.4–541.5, 542, 542.2–542.4
See application file for complete search history.

(56) References Cited

U.S. PATENT DOCUMENTS 1,803,043 A * 4/1931 Valentine et al. ..... 242/542.2
4,128,213 A 12/1978 Komulainen
4,171,106 A 10/1979 Crouse
4,475,696 A 10/1984 Birch et al.
5,441,213 A * 8/1995 Graham ..... 242/534.2
5,735,482 A 4/1998 Kuzik

FOREIGN PATENT DOCUMENTS

| | | |
|---|---|---|
| DE | 38 37 149 C2 | 5/1990 |
| EP | 1 053 447 B1 | 11/2000 |
| FR | 740724 A | 10/1931 |
| FR | 2 726207 A | 5/1996 |
| GB | 2 214 496 A | 9/1989 |
| JP | 5511342 A | 8/1980 |
| JP | 05276261 | 10/1993 |

* cited by examiner

*Primary Examiner*—Sang Kim
(74) *Attorney, Agent, or Firm*—Collard & Roe, P.C.

(57) ABSTRACT

The invention relates to a winding device (1) for winding up and unwinding goods (2) in web form, in particular a conveyor belt, whereby the wound goods (3) are supported on a substructure (4). The substructure has at least two support rollers (5, 6), which are disposed at a distance ($A_1$, $A_2$, $A_3$) from one another, whereby the support rollers are adjustable, changing the distance, in order to adapt themselves to any winding diameter ($D_1$, $D_2$), whereby the movement sequence of the support rollers takes place in such a manner that the wound goods are furthermore securely supported. It is practical if the winding device (1) is provided with lateral supports (7), which have a wheel that is adjustable in height, which is set to the center ($M_1$, $M_2$) of the wound goods (3). Lateral migration is prevented in this manner, for the purpose of optimizing a secured position.

7 Claims, 5 Drawing Sheets

WINDING DEVICE

CROSS REFERENCE TO RELATED APPLICATIONS

Applicant claims priority under 35 U.S.C. §119 of German Application No. 10 2004 037 217.9 filed Jul. 30, 2004. Applicant also claims priority under 35 U.S.C. §365 of PCT/DE2005/000730 filed on Apr. 12, 2005. The international application under PCT article 21(2) was not published in English.

BACKGROUND OF THE INVENTION

1. Field of the Invention

The invention relates to a winding device for winding up and unwinding goods in web form, in particular a conveyor belt, whereby the goods to be wound are supported on a substructure.

2. The Prior Art

Goods in web form are, for example, conveyor belts, sealing webs, rubberized fabrics, and printing blankets. Conveyor belts, which have a carrying side and a running side, as well as, in most cases, an embedded strength support in the form of woven fabric, steel cables, or aramid cables, are of particular importance. The winding technology of conveyor belts will therefore be discussed in greater detail in the following.

For the production of the endless connection (EP 1 053 447 B1) of a conveyor belt on site, on or next to the conveyor system, it is necessary to unwind the conveyor belt, which has been delivered as a round winding. Until now, this was done using a winding stand, the axle of which, which is set down on both sides, is inserted through the center of the conveyor belt winding. In this regard, there is a comprehensive state of the art, whereby the references DE 38 37 149 C2 and U.S. Pat. No. 5,735,482 are cited as examples.

The disadvantages of a winding stand are its great weight and its large dimensions. Since conveyor belt assembly takes place on construction sites, in most cases in a foreign country, winding stands can be made available only at great effort and expense.

SUMMARY OF THE INVENTION

For the purpose of avoiding the aforementioned disadvantage, the new winding device according to the invention supports the wound goods on a substructure that has at least two support rollers, which are disposed at a distance from one another, whereby the support rollers are adjustable, changing the distance, in order to adapt themselves to any winding diameter, whereby the movement sequence of the support rollers takes place in such a manner that the wound goods are furthermore securely supported.

Practical embodiments of this winding device are discussed below.

BRIEF DESCRIPTION OF THE DRAWINGS

The invention will now be explained, using exemplary embodiments and making reference to schematic drawings. These show.

DETAILED DESCRIPTION OF PREFERRED EMBODIMENTS

Figure 1:
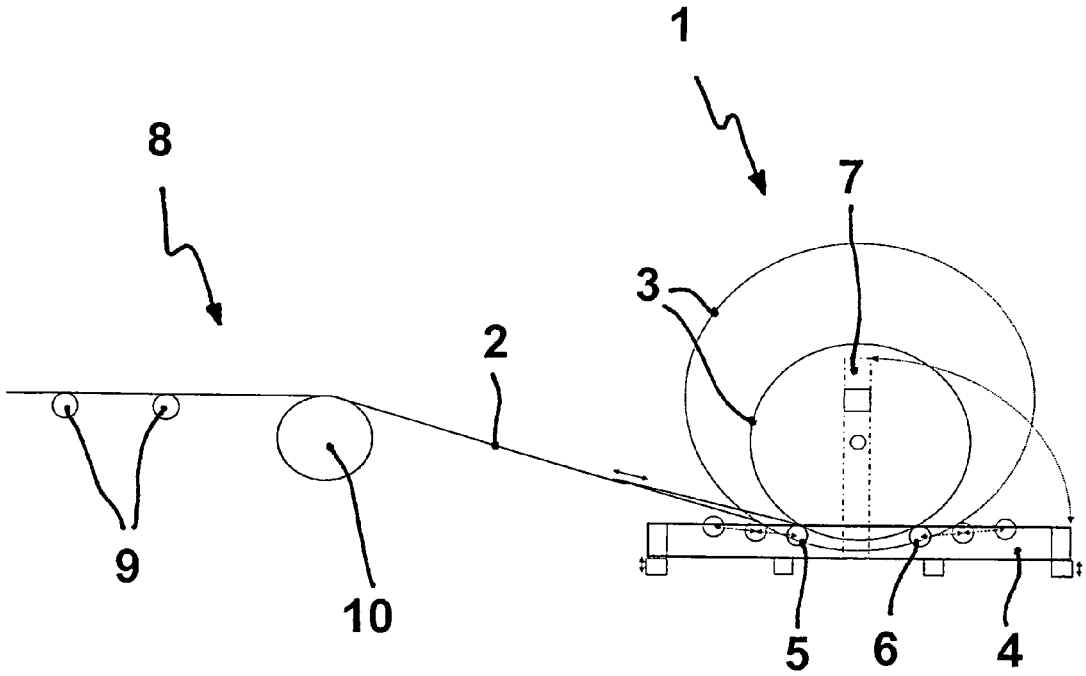
FIG. 1 a winding device with the feed or take-off region of the conveyor belt, respectively.

FIG. 1 shows a winding device 1 for winding up and unwinding a conveyor belt 2, whereby the two belt directions are indicated with a double arrow here. The wound goods 3 are deposited on a substructure 4. The substructure has two support rollers 5 and 6, which are adjustable horizontally and vertically. The movement sequence of these two support rollers within the substructure (double arrows) will be described in greater detail in connection with FIG. 2.

Furthermore, the winding device 1 is provided with lateral supports 7, the functional sequence of which will also be explained in greater detail below, within the scope of the description of FIGS. 2, 3*a*, and 3*b*.

Within the feed or take-off region 8, the conveyor belt is guided on additional support rollers 9 as well as a deflection drum 10.

Figure 2:
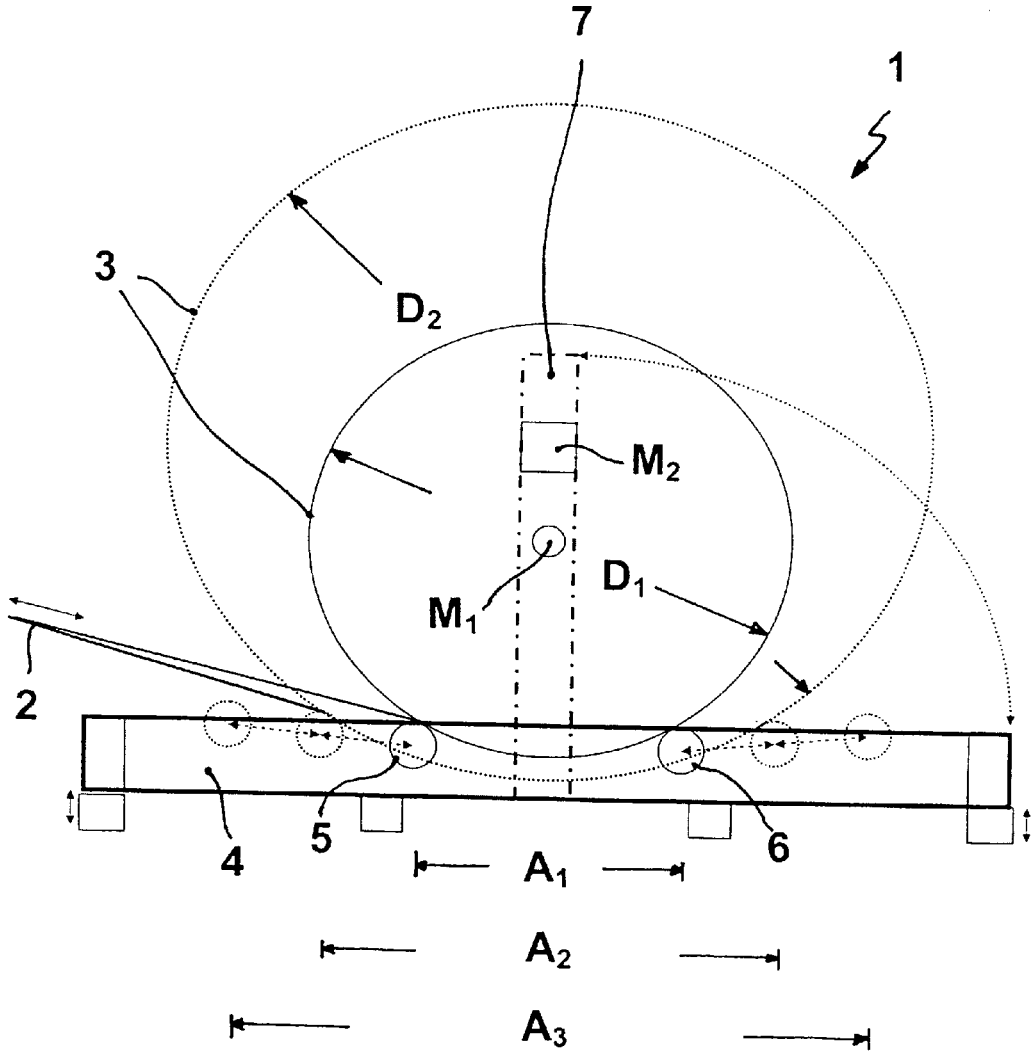
FIG. 2 an enlarged detail view of the winding device according to FIG. 1.

FIG. 2 shows details of the substructure 4 of the winding device 1. The two support rollers 5 and 6 are disposed at a distance $A_1$ (reference point: center point of support roller) from one another, with reference to the wound goods having a winding diameter $D_1$. As the conveyor belt 2 is fed in further, wound goods 3 having an increased winding diameter $D_2$ are formed. At the same time, an increase in the distance $A_2$ between the support rollers occurs. As the diameter of the wound goods increases further, a distance $A_3$ is finally reached. It is of significant importance that the support rollers are adjustable, changing the distance between them, in order to adapt to any winding diameter, whereby the wound goods must furthermore be securely supported. It is advantageous if the support rollers are adjustable horizontally and vertically. In this connection, the horizontal adjustment takes place essentially by means of the change in diameter of the wound goods. The additional vertical adjustment can take place indirectly, for example, by way of a height regulation of the substructure. This combined movement sequence of the support rollers can also be implemented by means of a combination of a horizontal and vertical guide rail within the support roller region, specifically without any height regulation of the substructure.

The winding device 1 is provided with lateral supports 7 that are set onto the center $M_1$ and $M_2$, respectively, of the wound goods 3. This additional measure is advantageous for those cases where the winding device cannot be sufficiently aligned horizontally.

Figure 5:
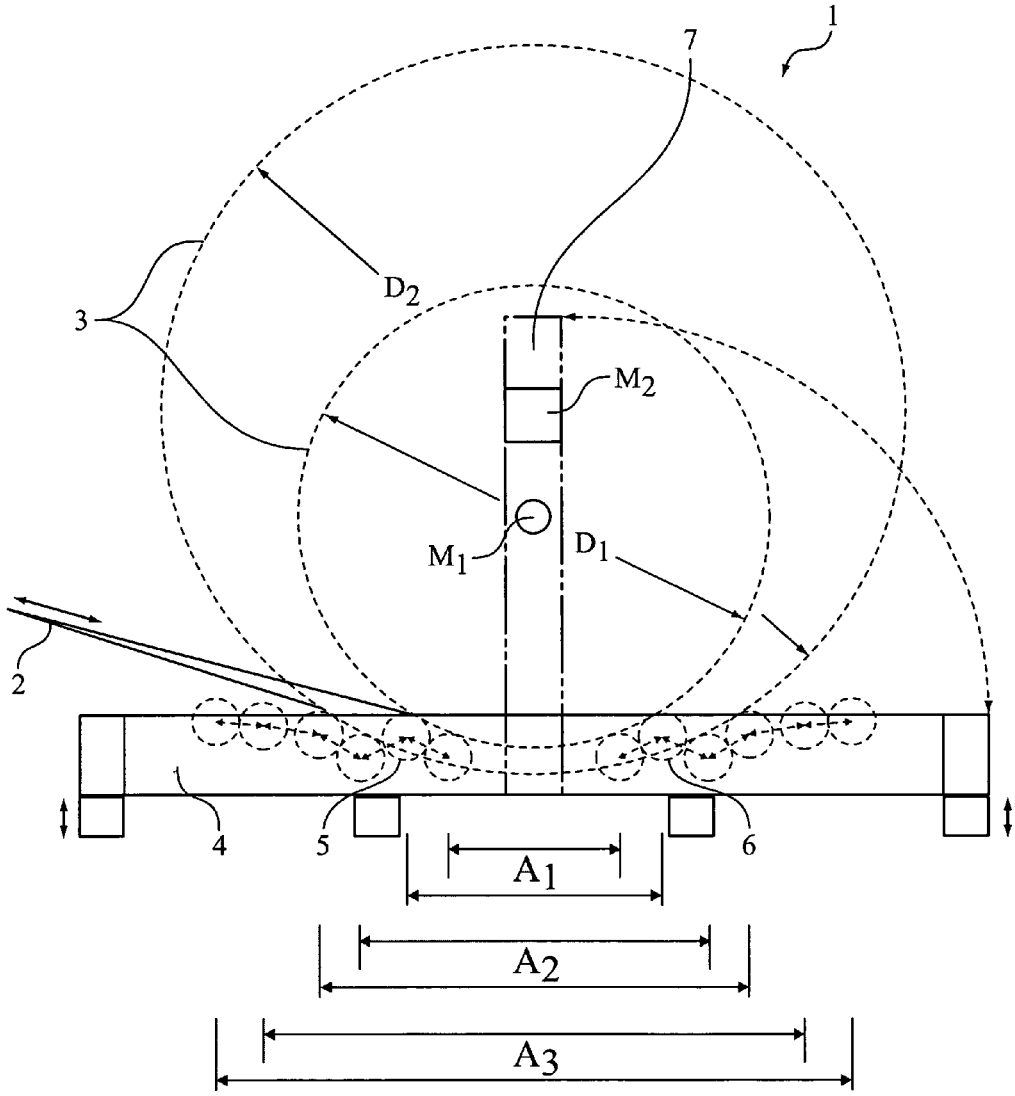
FIG. 5 an enlarged detail view of an embodiment of a winding device having two rows of two support rollers.

FIG. 5 shows an embodiment having a first row of at least two support rollers 5, 6 as well as a second row of also at least two support rollers 5, 6, with the two rows of support rollers disposed at a distance $A_1, A_2, A_3$ from each other analogously to the embodiment shown in FIG. 2.

Figures 3A, 3B:
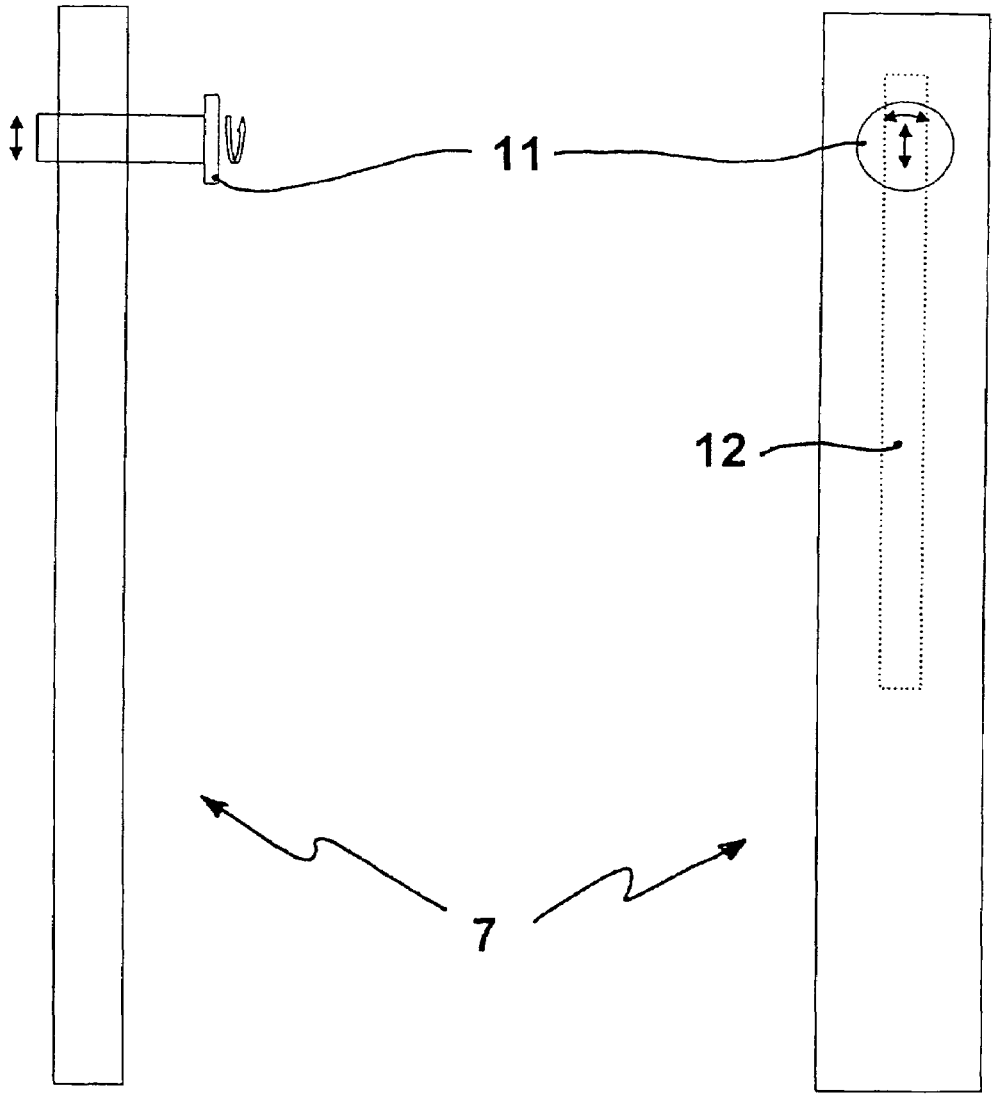
FIG. 3*a* a side view of a support.
FIG. 3*b* a front view of a support.

According to FIGS. 3*a* and 3*b*, the support 7 is provided with a wheel 11 that is adjustable in height (FIG. 3*b*, region 12), whereby the movement sequence, again, is indicated with double arrows. In this connection, the wheel is set to the center of the wound goods. Lateral migration is prevented in this manner.

Figure 4:
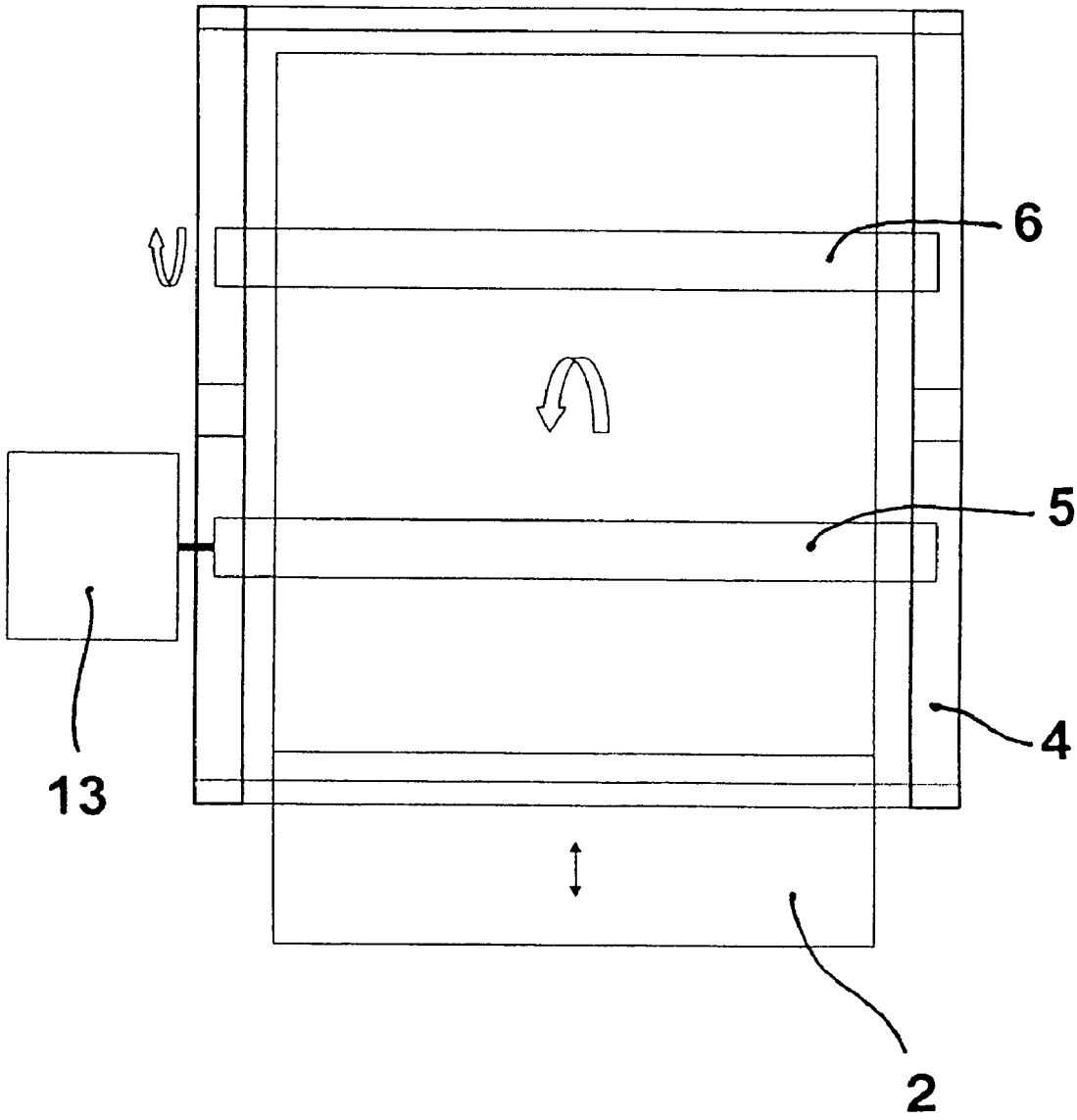
FIG. 4 the substructure of a winding device, with a drive motor for a support roller.

FIG. 4 again shows the substructure 4 with the two support rollers 5 and 6 for the conveyor belt 2. The support roller 5 is provided with a drive motor 13 and/or a brake, in order to accelerate or delay the winding process, respectively. In addition, this makes it possible to wind the conveyor belt up, i.e. back up.

REFERENCE SYMBOL LIST

1 winding device
2 goods in web form (conveyor belt)
3 wound goods (belt winding)
4 substructure
5 first support roller
6 second support roller
7 support
8 feed or take-off region
9 support rollers
10 deflection drum
11 wheel
12 height-adjustable region of the wheel
13 drive motor
$A_1$, $A_2$, $A_3$ distance between two support rollers
$D_1$, $D_2$ winding diameter
$M_1$, $M_2$ center of the wound goods

The invention claimed is:

1. A winding device for winding and unwinding a product in web form comprising a substructure for supporting a wound product comprising at least first and second supporting rollers that are placed at a distance from one another, the distance between the first and second supporting rollers being adjustable as the winding diameter of the product changes corresponding to the winding and unwinding of the product, the first and second supporting rollers configured to be vertically and horizontally displaceable in order to adapt to each winding diameter, wherein the supporting rollers have a course of motion such that the wound product is held securely.

2. The winding device according to claim 1, wherein exclusively two supporting rollers are present.

3. The winding device according to claim 1, wherein a first row of at least two supporting rollers as well as a second row of also at least two supporting rollers are present, the two rows of supporting rollers being disposed at a distance from one another.

4. The winding device according to claim 1, further comprising a plurality of lateral supports having a height-adjustable wheel placed in a middle portion of the wound product.

5. The winding device according to claim 1, wherein at least one supporting roller is provided with at least one of a drive motor and a brake, in order to accelerate or delay winding, respectively.

6. The winding device according to claim 1, wherein the supporting rollers are vertically displaceable by way of a height regulation of the substructure.

7. The winding device according to claim 1, further comprising a horizontal and vertical guide rail within a supporting roller region, wherein the supporting rollers are disposed in the supporting roller region and are horizontally and vertically displaceable along the guide rail.

* * * * *